United States Patent [19]

Fuller

[11] 4,109,430

[45] Aug. 29, 1978

[54] DEMOUNTABLE PARTITION WALL

[76] Inventor: Ronald George Fuller, P.O. Box 337, Hudson Heights, Quebec JOP IJO, Canada

[21] Appl. No.: 712,886

[22] Filed: Aug. 9, 1976

[51] Int. Cl.[2] ..... E04B 2/32

[52] U.S. Cl. ..... 52/127; 52/241; 52/593

[58] Field of Search ..... 52/238, 241, 242, 122, 52/127, 284, 286, 593

[56] References Cited

U.S. PATENT DOCUMENTS

| | | | |
|---|---|---|---|
| 2,325,694 | 8/1943 | Marshall | 52/349 |
| 2,453,326 | 11/1948 | Lambert | 52/593 |
| 2,505,903 | 5/1950 | Madger | 52/241 |
| 3,243,929 | 4/1966 | Strandlund | 52/593 |
| 3,453,790 | 7/1969 | Harris | 52/241 |
| 3,803,787 | 4/1974 | Daggy | 52/241 |

FOREIGN PATENT DOCUMENTS

| | | | |
|---|---|---|---|
| 251,840 | 1/1967 | Austria | 52/241 |
| 245,216 | 2/1966 | Austria | 52/122 |
| 1,410,499 | 10/1975 | United Kingdom | 52/241 |

*Primary Examiner*—John E. Murtagh
*Attorney, Agent, or Firm*—Edward J. Brenner

[57] ABSTRACT

Panels constructed from a light weight core bonded to specially shaped perimeter members such that the vertical members overlap and interlock with similar members on adjacent panels whereby transverse motion of adjacent panels toward the common center line serves to urge adjoining panels into close abutment, top and bottom runners with an elastomerically biased member mating with the horizontal perimeter members such as to grip the panels inserted between them while providing a centering force which serves to both align the panels and abut them to form a continuous batten free wall without the use of any other mechanical fastenings. Provision is made for locking the biased member in order to inhibit the removal of panels.

Such demountable partition walls may be erected and dismantled without the use of tools or skills or interference with the building structure or furnishings.

7 Claims, 4 Drawing Figures

DEMOUNTABLE PARTITION WALL

BACKGROUND TO THE INVENTION

This invention relates to improvements in non structural wall panels and methods for assembling same into partition walls without the use of tools or the exercise of special skills by the deployment of a single artisan.

The art discloses many methods for erecting demountable partitions all of which require the use of tools and skills to a greater or lesser extent and are demanding of labour and time. In many cases the finished wall surface is marred by vertical battens necessary to conceal panel joints and in others individual panels can be readily removed to obtain unauthorised access between rooms.

It is an object of the present invention to provide a method for the economical manufacture of interlocking panels together with means for assembling a plurality of same into a flush faced demountable partition wall wherein said panels may be locked and made immovable until unlocked without the use of studding or other vertical members additional to the panels.

It is a further object of the invention to provide a demountable partition wall which can be erected over floor covering and which is completely recoverable for reassembly elsewhere without the use of fasteners or other loose components for locating and securing said interlocking panels when assembled into a demountable partition wall.

Accordingly, a preferred embodiment of this present invention provides for panels, each constructed from a lightweight core which may be a cellular composition to minimise handling weight whilst optimising thermal and accoustical attenuation, to the four edges of which precisely dimensioned perimeter members having a low coefficient of friction are bonded in course of manufacture. The perimeter members along the vertical sides of said panels are characterised by longitudinal overlapping interlocking surfaces which are so fashioned that adjacent members of abutting panels may be interlocked by a transverse movement to bring adjacent panels to a common centerline, the interlocking surfaces being so inclined to the normal as to develop a wedging effect which draws adjacent panels into close abuttment as they are centered.

The panels are assembled into a wall between a top runner and a bottom runner one of which is provided with a movable member biased to an outward position toward the other runner, both the said movable member and the other runner being contoured to mate with the horizontal perimeter members of the panels such that when a panel is offered into place between the outwardly biased movable member and the other runner it is gripped between same with sufficient force to center the panel and thereby bring same into register and close abutment to its neighbour.

The top and bottom runners are retained in position against the wall and ceiling by the action of the biasing force assisted by gravity without the use of mechanical fasteners.

It follows that such partition walls may be readily assembled and dismantled with the minimum of labour and without disturbing the building fabric or furnishings, and are capable of complete recovery for use elsewhere without the necessity of making good after removal.

The panel assembly may be locked into position by restraining the further movement of the biased movable member which may be readily done by means of a simple cam arrangement under the control of a keyed lock, or alternatively by mechanically, electrically, or otherwise actuated latches.

A preferred method for making the panels is by lining a cavity mould with the four perimeter members and two finished face laminates, the volume so defined being filled with a foaming polymer, expanded mineral, fibres, or other suitable low density or spacial material which becomes bonded to the perimeter members and face lamina in course of curing bonding material introduced for the purpose.

DRAWING

In the drawing illustrating embodiments of the invention:

Figure 1:
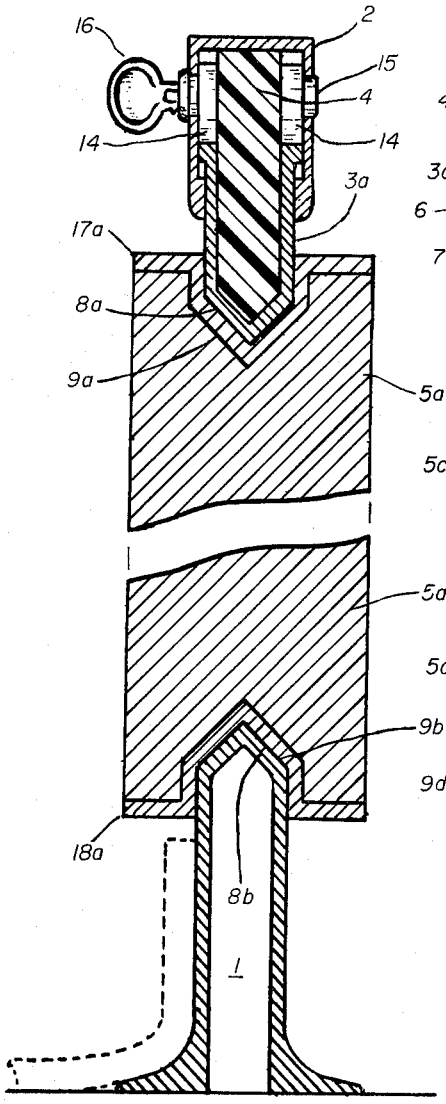
FIG. 1 shows an end elevation of a vertical section through the runner and panel components of one embodiment.

Referring to the drawing 1 is a bottom runner mounted to the floor, 2 is a top runner mounted to the ceiling or other suitable support. The top runner 2 is provided with a movable member 3 slidably engaged in a vertical plane and biased to rest in an extended position by an elastomeric backing pad 4. Panel members 5 are introduced between runners 1 and 2 by abutting the top horizontal perimeter member 17 against movable member 3 thereby displacing same vertically against compressable pad 4 under the urging of the panel until bottom horizontal perimeter member 18 can be brought into register with bottom runner 1. The panel assemblies 5 are centered on a common vertical axis between runners 1 and 2 by the urging provided the sides of runner 6 upon panel surfaces 7 in the embodiment illustrated in FIG. 2, or by detent 8 engaging with an indentation 9 provided in the horizontal perimeter members 17 and 18 in the embodiment illustrated in FIG. 1.

The vertical perimeter members 10 incorporated in panel 5 are provided with interlocking lips having an abutting face 11 and a mating face 12 inclined from its juncture with face 11. Interaction between faces 12 of abutted mated perimeter members under the urging and centering effort imposed on the panels by pad 4 assisted by gravity and aided by the interaction of member 6 upon panel surfaces 7 or alternatively by detent 8 and indentation 9 serve to bring faces 11 into close abutment one with the other whilst bringing panel sides 7 into flush relationship with one another to form a continuous wall.

A partition wall so assembled may be dismantled by lifting panel 5 against the resistance of pad 4 until same is compressed to an extent necessary to permit the disengagement of of bottom horizontal perimeter member 18 from runner 1 thereby permitting the panel assembly to be withdrawn sideways from the wall out of engagement with runners 1 and 2.

It has been found that the biasing effect of pad 4 enables runners 1 and 2 to be held in position against floor and ceiling without any other anchorage. The bottom runner 1 may accordingly be run across carpeting or other floor covering and the top runner 2 may be held in place by adhesive pressure tape until located by the assembly of panels.

Figure 2:
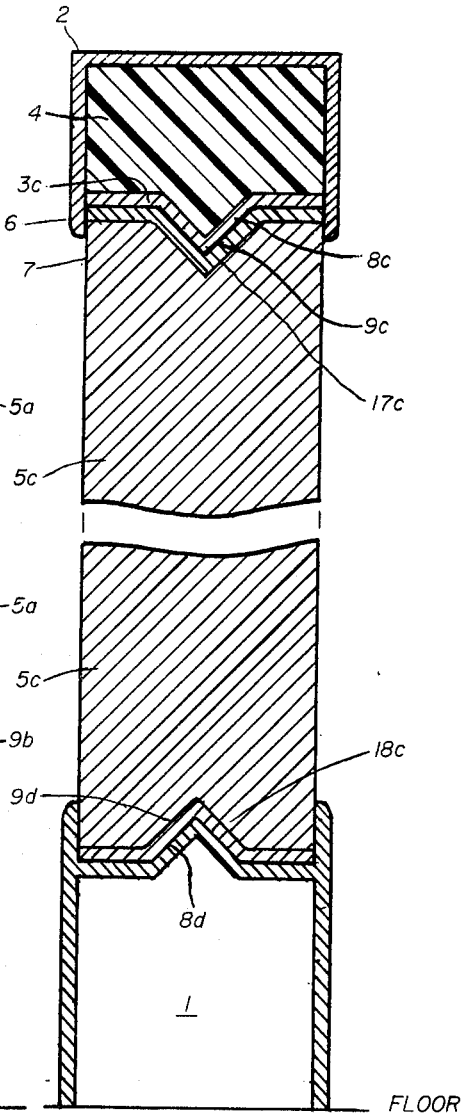
FIG. 2 shows an end elevation of a vertical section through the runner and panel components of an alternative embodiment.
Figure 3:
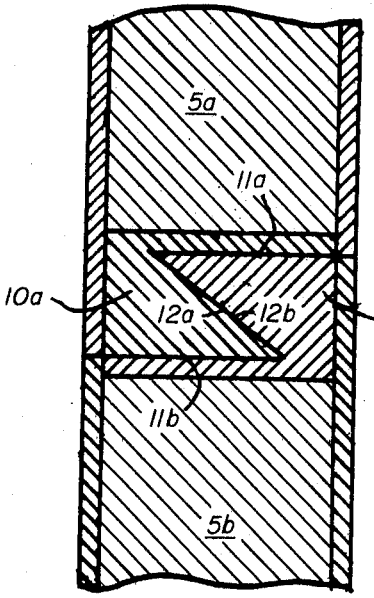
FIG. 3 shows a plan view of a section through the mating vertical side members of two adjacent abutting panels of one embodiment.
Figure 4:
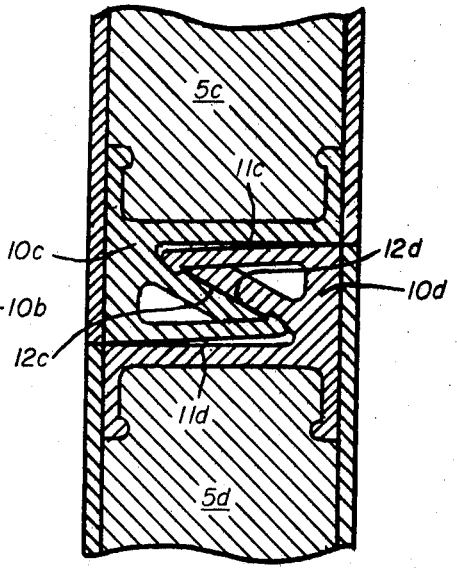
FIG. 4 shows a plan view of a section through the mating vertical side members of two adjacent abutting panels of an alternative embodiment.

Unauthorised dismantling may be prevented by restraining the movement of member 3 with respect to runner 2. One such embodiment is illustrated in FIG. 1, wherein 14 is a cam rotatably mounted in unit with axis 15 through the side walls of runner 2 such that cam 14 may be rotated on it's axis to bring the cam lobe either into or out of contact with member 3 such that said member me be mechanically restrained from moving back from its lowermost position in abuttment with the panel member 17 when 14 is in the first position, and free to move when in the second position. Cam 14 may be conveniently rotated and locked in either the clear or interference positions by means of a key and barrel lock mechanism 16 introduced axially into the body of the cam axis 15. Such arrangement enables individual panels to be removed at will as may be necessary for passing through the wall large items of equipment too big to pass a doorway, such as computor components, etc. Alternatively a plurality of cams may be mounted on a common shaft running the length of runner 2 such that an entire wall assembly may be controlled from one lock and operating position. Solenoid or other latching may also be used.

It will be apparent to one well versed in the art that door frame and/or window modules may be provided with perimeter members similar to those provided the panels in a given wall and be made interchangable therewith in such a manner that door frame or window modules, etc., may be substituted for one or more panel members of a plurality of panels conjoined to form a partition wall.

Since it is essential for the proper working of the invention that the perimeter members of the individual panels be both very precisely and identically dimensioned and have mating surfaces possessive of very low coefficient of friction, a novel method will now be disclosed for economically producing suitable panel assemblies;

Bottom, top, and side perimeter members are formed to the desired precision cross section by extrusion, preferably using a polymeric material such as High Density Poly-Ethelene which is relatively cheap and possesses desirable mechanical properties together with a low coefficient of friction. Precut lengths of suitable extrusion are introduced into the cavity of a panel mould and are appropriately placed with their mating edges facing outwards around the perimeter of the mould in the positions they will occupy on the finished panel on a veneer previously placed on the bottom inside face of cavity to form an external panel surface. The cavity formed by said veneer and said perimeter extrusions is filled with any suitable low density material and which might be a foaming polymeric material, expanded beads such as perlite, or fibrous materials such that the material alternates with air spaces.

Polymeric material is introduced to the cavity together with a suitable blowing agent after the cavity is closed off over a top side finishing veneer. Isocyanate based formulations have been found very suitable and in common with other polymers are a powerful adhesive prior to curing and serve to bond together the perimeter and veneer members together with any filler material in the cavity and the pressure generated in course of curing serves to positively locate and define the outer surfaces against the mould and which serves to duplicate any contouring or graining formed for the purpose on the inner faces of the mould covers. Panels may be so formed with or without veneers.

The invention further resides in the combination, construction, and arrangement of parts with reference to the accompanying drawing.

What I claim is:

1. An assembly of wall panels comprising a plurality of like panels assembled between a horizontal bottom runner and a horizontal top runner, wherein the vertical edges of said panels when standing each have longitudinally extending surfaces, each of said surfaces having at least two surfaces inclined one to the other to form a wedge shaped groove with an axis transverse the panel to permit an interlocking mating joint to be formed between adjacent like panels when said edges are interlocked by simple transitional movement of one panel relative to the other in a direction normal to the plane of the panels, the said longitudinally extending surfaces being arranged so that they ae urged into close abutment when said panel is centered between said horizontal runners on a centerline common to an assembly of said panels in edge to edge relationship and biassing means provided to impose a vertical force upon each of said panels when introduced between said runners to center said panel on a centerline common to the said assembly of like panels.

2. A combination as claimed in claim 1 wherein the said panels include a low density core.

3. An assembly of wall panels comprising a plurality of wall panels wherein the vertical edges of the panels when standing each have longitudinally extending surfaces, each of said surfaces having at least two surfaces inclined one to the other to form a wedge-shaped groove with an axis transverse the panel to permit an interlocking mating joint to be formed between adjacent panels when said edges are interlocked by simple transitional movement of one panel relative to the other in a direction normal to the plane of the panels, the said longitudinally extending surfaces being arranged so that they are urged into close interlocking abutment when said panel is centered between contoured horizontal runners on a centerline common to an assembly of said panels in edge to edge relationship and wherein at least one said runner includes a retractible member captive thereto and extending longitudinally thereof and displaceable between innermost and outermost positions under the control of means resiliently biassing same to its outermost position.

4. An assembly of like wall panels as claimed in claim 3 wherein said biassing means is an elastomeric pad.

5. A combination as claimed in claim 3 wherein means is provided to restrain each biassing means in a biassed position against said panels.

6. A combination as claimed in claim 5 wherein each said restraining means is lockable.

7. A combination as claimed in claim 6 wherein said restraining means is lockable under the control of a removeable key.

* * * * *